United States Patent [19]

Rabson

[11] Patent Number: 4,538,970

[45] Date of Patent: Sep. 3, 1985

[54] DOWNSTROKE LIFT PUMP FOR WELLS

[76] Inventor: Thomas A. Rabson, 4521 Ivanhoe, Houston, Tex. 77027

[21] Appl. No.: 542,849

[22] Filed: Oct. 17, 1983

[51] Int. Cl.[3] ..... F04B 17/04; F04B 21/02

[52] U.S. Cl. ..... 417/417; 417/439; 417/557

[58] Field of Search ..... 417/417, 416, 259, 260, 417/557, 241, 439

[56] References Cited

U.S. PATENT DOCUMENTS

| | | | |
|---|---|---|---|
| 1,655,825 | 1/1928 | Schmidt | 417/417 |
| 1,699,726 | 1/1929 | Warmuth | 417/259 |
| 2,006,592 | 7/1935 | Freeman | 417/259 |
| 2,083,058 | 6/1937 | De Weal | 417/547 |
| 2,253,780 | 8/1941 | Gurley | 417/547 |
| 2,604,049 | 7/1952 | Martin | 417/417 |
| 2,833,220 | 5/1958 | Robinson et al. | 417/540 |
| 3,116,695 | 1/1964 | Fuller | 417/241 |
| 3,756,750 | 9/1973 | Summerfield | 417/241 |
| 4,350,478 | 9/1982 | Oldershaw et al. | 417/417 |

OTHER PUBLICATIONS

"Intro. to Petroleum Production", 1982, Gulf Publishing Comp., Houston, TX, pp. 55–63.

Brantly, "Rotary Drilling Handbook", 1961, Palmer Publications, N.Y., N.Y. pp. 599, 600.

*Primary Examiner*—Cornelius J. Husar

*Assistant Examiner*—Peter M. Cuomo

[57] ABSTRACT

A reciprocating electric motor-pump assembly for wells lifts well fluid on downstroke of the motor-pump assembly, and with the motor above the pump the well fluid is conducted from below the motor to above the motor via a flow passage through the motor armature, which is tubular.

5 Claims, 2 Drawing Figures

Fig. 1
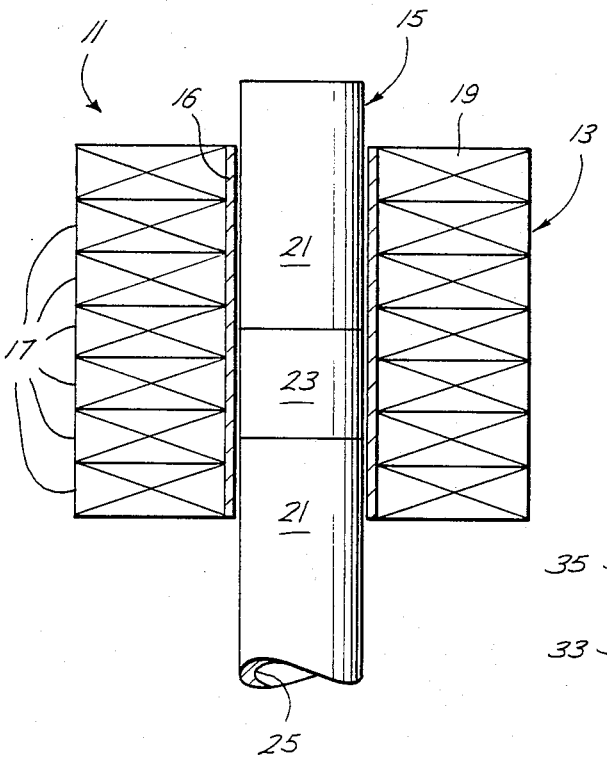
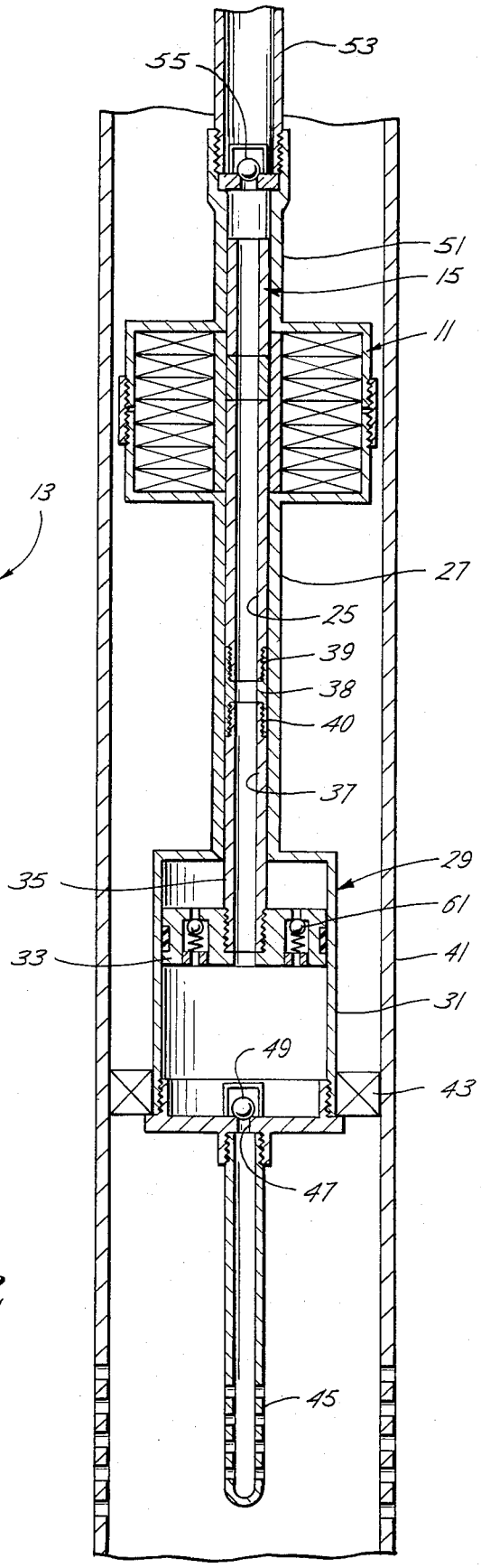
Fig. 2

DOWNSTROKE LIFT PUMP FOR WELLS

SUMMARY OF THE INVENTION

This invention relates to downhole reciprocating electric motor driven reciprocating pumps for wells.

According to the invention the overall size and cost of the pump motor is decreased by lifting the liquid on the downstroke so that the weight of the motor armature and the pump piston add to the force of the electric motor. If the combined weight of the moving parts plus the motor force equals the liquid load, the motor force required can thereby be reduced to one-half the force required to elevate the liquid and the motor will still be strong enough to lift the armature and pump piston on the upstroke.

The motor armature is tubular to provide a path for upflow of fluid on the motor downstroke.

BRIEF DESCRIPTION OF DRAWINGS

For a detailed description of a preferred embodiment of the invention, reference will be made to the accompanying drawings wherein FIG. 1 is a schematic view of a reciprocating electric motor embodying the invention, and FIG. 2 is a vertical section through a well showing a motor pump installation in accordance with the invention.

DETAILED DESCRIPTION OF THE INVENTION

Referring now to FIG. 1, there is shown a reciprocating electric motor 11 including a stator 13 and a mover of armature 15.

The stator includes a plurality of coils 17 stacked on a non-ferromagnetic tube 16 and means 19 energizing the coils with unidirectional current repeatedly in a desired succession from top to bottom and then reversing to energize the coils repeatedly in a desired succession in the opposite direction with current flow in the same direction.

The armature includes a plurality of ferromagnetic sections 21 separated by non-ferromagnetic material 23. The sweeping magnetic field produced by the stator field coils 17 will magnetize the armature by magnetic induction and cause it to reciprocate. For further description of such a motor see applicant's contemporaneously filed patent application Ser. No. 542,634 filed Oct. 17, 1983 entitled Periodic Reciprocating Motor.

Armature 15 is tubular, providing a flow passage 25 therethrough.

Referring now to FIG. 2, connected to the lower end of motor 11 by a tube 27 is a pump 29 including a barrel or cylinder 31. A plunger or piston 33 reciprocates within cylinder 31. Piston rod 35 connected to the piston is tubular, providing a flow passage 37 which communicates with flow passage 25 of the motor armature, the armature being connected to the piston rod by tubular counterweight 38, there being threaded connections between the piston rod, counterweight, and armature as shown at 39 and 40.

Pump cylinder 31 is sealed to and supported by well casing 41 through hookwall packer 43. A perforated, production nipple 45 is connected to the lower end cylinder 31 about inlet 47 thereto. A ball check standing valve 49 controls flow through inlet port 47, allowing an upflow but preventing down and out flow.

At the upper end of motor 11 about tubular armature 15 thereof is an outlet pipe 51 connected to production tubing 53. An upper ball check standing valve 55 is disposed in outlet 51.

Piston 33 includes one or more bypass ball check valves 61 which allow flow from the upper to lower side of the piston as the motor lifts the piston. At the same time oil rises into the cylinder via inlet 47 and check valve 49. Standing valve 55 keeps oil in tubing 53 from dropping back down during the upstroke of the piston.

When the motor thereafter drives the piston down, in cooperation with the weight of the motor armature, oil beneath the piston is forced up in the tubular piston rod and motor armature and past standing valve 55 into tubing 53.

Preferably the force of the motor is just enough to lift the motor armature, pump piston, and other moving parts including any added counterweights on the motor upstroke. Expressed algebraically:

$$F=W$$

where F is the motor force and W is the combined weight of the moving parts.

On the downstroke, $$F+W=L=PA$$

That is, the motor force plus weight must equal the load (L). The load is the static pressure (P) of the liquid to be lifted multiplied by the cross-sectional area (A) of the pump outlet, i.e. the passage 37. According to Pascal's law, the static pressure (P) is equal to the depth (H) multiplied by the density of the liquid (D). According to the Rotary Drilling Handbook by J. E. Brantly, Sixth Edition, published by Palmer Publications, copyright 1961 at page 599: "The density of a substance is its weight per unit volume. For example the density of water is 62.417 lb. per cu. ft." Thus, the static pressure (P) of the liquid load is equal to the depth (H) of the pump outlet below the earth's surface multiplied by the density (D) of the liquid produced by the well.

From the foregoing it will be seen that $$W=L-F$$

$$F=L-F$$

$$2F=L$$

$$F=\tfrac{1}{2}L.$$

In other words, the motor need furnish only ½ the force required to lift the liquid load.

Of course the preferred parameters namely $$F=W=\tfrac{1}{2}L$$

will not normally be achieved but more advantage will be had if these forces are of the same order of magnitude, e.g. equal within about 10 percent.

While a preferred embodiment of the invention has been shown and described, modifications thereof can be made by one skilled in the art without departing from the spirit of the invention.

I claim:

1. Motor pump assembly including:

a reciprocating electric motor having a stator and a mover, and a reciprocating pump having a barrel and a plunger and an inlet and an outlet, said barrel being connected to said stator, said mover being connected to said plunger, said motor and pump being adapted to operate in a well with said mover and plunger reciprocating up and down and said inlet and outlet communicating with the volume of said barrel which volume is located at the underside of said plunger, said inlet including inlet check valve means having an open position and a closed position, flow through said inlet check valve means into said volume being allowed when said inlet check valve means is in open position and prevented when said inlet check valve means is in closed position, said outlet including outlet check valve means having an open position and a closed position, flow through said outlet check valve means from said volume being allowed when said outlet check valve means is in open position and prevented when said outlet check valve means is in closed position, said motor providing means to reciprocate the plunger up and down in the barrel, said pump providing means on the downstroke of the plunger to expel fluid from said volume of the pump barrel and through said outlet check valve means and elevate fluid above the assembly when the pump is suitably positioned in a well bore, and said motor and pump providing means to move said plunger on the upstroke allowing fluid to enter said volume through said inlet check valve means, said motor and pump including means comprising said outlet check valve means for maintaining said fluid above said assembly at rest during said upstroke, said motor and stator including electromagnetic means cooperable with gravity to exert downward force on the plunger on the downstroke when the fluid is being elevated, said electromagnetic means acting counter to gravity to exert upward force on the plunger on the upstroke to elevate the plunger while the fluid above the assembly remains at rest, whereby the fluid above the assembly is lifted during but only during downstroke of the plunger.

2. Assembly according to claim 1;

said mover being tubular and connected to the pump outlet to transmit fluid expelled from the pump.

3. Assembly according to claim 1;

said assembly including counterweight means connected to the system comprising the mover and plunger.

4. Assembly according to claim 1;

the force of the motor being of the same order of magnitude as the combined weight of the system comprising the mover, piston, and any associated moving part.

5. Assembly according to claim 1 disposed in a well, the force of the motor being of the same order of magnitude as one-half the force required to lift the expected load expressed in the same units as the motor force, the force required to lift the liquid load being equal to the area of the pump outlet multiplied by the depth of the pump outlet below the earth's surface times the density of the liquid produced by the well.

* * * * *